US008696079B1

(12) United States Patent
Solo

(10) Patent No.: US 8,696,079 B1
(45) Date of Patent: Apr. 15, 2014

(54) DRAWER DISPLAY AND STORAGE ORGANIZER SYSTEM

(76) Inventor: Judith Bonnie Solo, Las Vegas, NV (US)

( * ) Notice: Subject to any disclaimer, the term of this patent is extended or adjusted under 35 U.S.C. 154(b) by 229 days.

(21) Appl. No.: 13/071,498

(22) Filed: Mar. 24, 2011

(51) Int. Cl.
*A47B 88/00* (2006.01)

(52) U.S. Cl.
USPC ..... 312/348.3

(58) Field of Classification Search
USPC ..... 312/348.3
See application file for complete search history.

(56) References Cited

U.S. PATENT DOCUMENTS

| | | | | |
|---|---|---|---|---|
| 4,598,341 | A * | 7/1986 | Brackhahn et al. | 362/125 |
| 5,607,215 | A | 3/1997 | Pacetti et al. | |
| 5,664,856 | A | 9/1997 | Pacetti | |
| 5,800,031 | A * | 9/1998 | Hanneman et al. | 312/348.3 |
| 6,129,433 | A * | 10/2000 | Rosenberg et al. | 312/348.3 |
| 6,305,567 | B1 * | 10/2001 | Sulpizio | 220/495.11 |
| 6,871,921 | B2 | 3/2005 | Ernst | |
| 7,040,724 | B2 * | 5/2006 | Kelley et al. | 312/205 |
| 7,055,682 | B1 * | 6/2006 | Domotor et al. | 206/214 |
| 2002/0171344 | A1 * | 11/2002 | Hollenstein | 312/348.3 |
| 2004/0159560 | A1 * | 8/2004 | Viverito | 206/6.1 |
| 2005/0287316 | A1 * | 12/2005 | Croce | 428/34.1 |
| 2006/0124647 | A1 * | 6/2006 | Rosenberg et al. | 220/500 |
| 2007/0159040 | A1 | 7/2007 | Fernandez et al. | |
| 2007/0262683 | A1 * | 11/2007 | Creed | 312/290 |
| 2008/0258593 | A1 | 10/2008 | Berger | |
| 2009/0121593 | A1 * | 5/2009 | Greiner | 312/224 |

FOREIGN PATENT DOCUMENTS

| | | | | |
|---|---|---|---|---|
| JP | 05228032 | A * | 9/1993 | A47B 67/00 |

* cited by examiner

*Primary Examiner* — Hanh V Tran
(74) *Attorney, Agent, or Firm* — Connie R. Masters

(57) ABSTRACT

A convenient drawer organizer storage and display system is provided, which includes a display base member and at least one storage module configured to hold personal items, such as jewelry or accessories. The display base member is fashioned of a single piece of fabric having a dense pile face. The display base member is manually positionable to cover the drawer bottom surface. One or multiple storage modules are positionable on the display base member, with any unutilized surface of the display base member functioning as a display space. Thus the display space available for storage of items includes both the space within the storage modules and the unutilized surface of the display base member. Variations of storage modules are also presented.

9 Claims, 10 Drawing Sheets

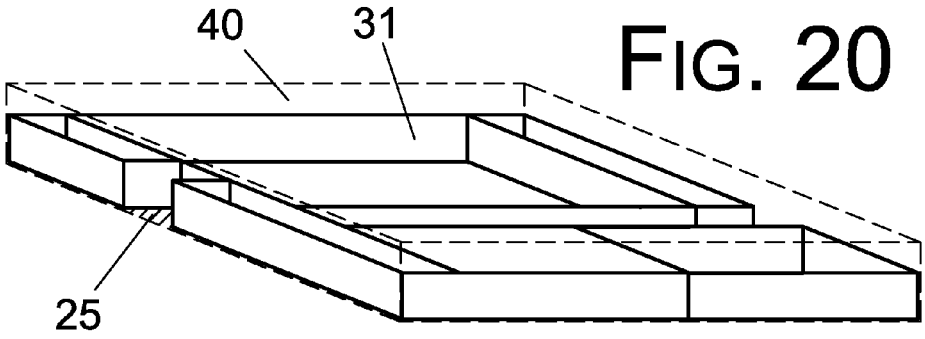
FIG. 20
FIG. 21
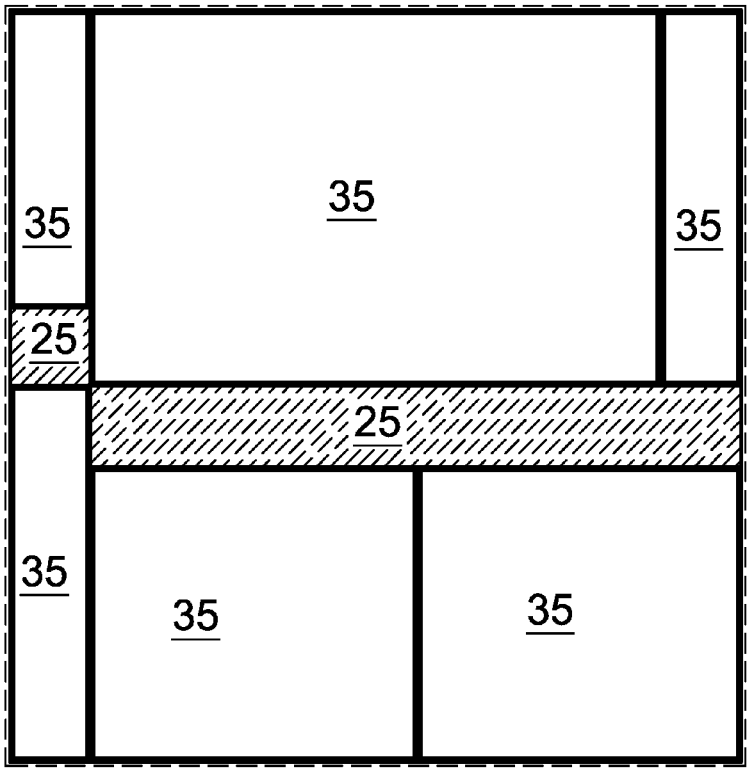

DRAWER DISPLAY AND STORAGE ORGANIZER SYSTEM

FIELD OF THE INVENTION

The present invention relates generally to a modular drawer organizing system, and more particularly, to an easily customizable drawer organizing system for storing objects, such as jewelry or personal accessory items, in an accessible manner.

BACKGROUND INFORMATION

Efficiently storing, accessing, and retrieving jewelry or other small personal accessory items is often problematic. Though almost every house or apartment has drawers in which items can be stored, this open storage leads to disarray and clutter as the unrestricted space in the drawers allows the jewelry and accessories to become a confused jumble. Not only are the items difficult to find, but also damage may occur as they contact and intermesh with each other. For example, pulling a single thin gold chain out of the tangled mess may be impossible without damage to the chain.

To address this problem, consumers tend to obtain a variety of containers to try to add structure to the open drawer space. Thus the drawer is often filled with an assortment of plastic boxes, metal trays, recycled food containers, hardware sorting boxes, ice cube trays, and various other commissioned containers. While these may provide interior structure for the open drawer space, the motley collection is unsightly and displeasing. Additionally, the containers are not configured for the sizes and shapes of the jewelry and accessories, nor are they configured for easy access to the desired item. Further, the container collection rarely fits the drawer well. The containers shift and move as the drawer is opened and shut, plus unused space is left between the ill-fitting containers. Thus items may be lost or damaged as they slip under and between the containers.

Therefore, numerous flat and stacking trays are available that are configured and partitioned to hold jewelry and accessories. Placing these into a drawer improves the unsightly situation, but it is not possible to provide drawer trays and containers in every size to precisely fit drawers, because drawers are not uniform in size from one house to the next or even from one room to the next. Commercially available partitioned trays may fill a section of the drawer, but leave unused drawer space. When the drawer is opened and shut, the available partitioned trays or containers still slide from side to side or front to back into the unutilized space between them.

One approach to accommodating the differences in sizes of the drawer interiors is to hire a carpenter to individually construct custom-made partitioned trays to fit snuggly into the drawers. To be satisfactory, these custom-made trays are configured for the particular jewelry and accessories of the consumer. However, this approach is too costly for the average consumer. Nor is it feasible for manufacturers to provide partitioned trays in every size and shape for a good fit in the consumer's non-standard size drawers.

Another approach to deal with variations in drawer size is the provision of drawer organizing containers with an adjustable portion that slides in or out to accommodate drawers of differing widths. Though the container can become wider or narrower, an instability remains where the sliding portion connects to the container, thus the container is not sturdy. Also, the sliding portion may slip away from the drawer side leaving unused drawer space. Additionally, the sliding section is necessarily not fully connected to the container, so small items can slip into the crack between them or become scratched due to slippage. Further, the adjustable side has a functional appearance, which is not aesthetically pleasing and is, therefore, less desirable for many applications.

Accordingly, there is an established need for an efficient, attractive, customizable drawer storage organizer system that utilizes the drawer space systematically and fully, and additionally, allows the consumer to view, retrieve and replace jewelry and accessories effortlessly.

SUMMARY OF THE INVENTION

The present invention is directed to a convenient, attractive drawer organizer storage and display system that includes a display base member and at least one storage module, with both the base member display surface and the storage module (s) configured to hold personal items, such as jewelry or accessories. After placing the desired storage modules into the drawer, the base member display surface between the storage modules is used as additional storage space. Therefore the horizontal space of the drawer is fully utilized.

The display base member is fashioned of a single piece of fabric having a dense pile face, such as velvet fabric. The fabric is manually positioned in the bottom of the drawer to cover the drawer bottom surface. To aid in obtaining a good fit, the fabric may be custom cut to fit, folded under, or adhesively attached.

The storage module may have a single compartment or may be divided into multiple compartments configured in specific sizes or for particular items. At least one storage module is used per drawer, but generally multiple storage modules are manually situated on the display base member in a pattern contemplated to optimize storage of the particular items to be stored within the particular drawer being organized. In addition to the interior compartment or compartments of the storage modules, any surface area of the display base member that is unoccupied by storage modules is available for storage and/or display space, because the plush fabric of the display base member is suitably attractive and protective to serve this purpose in a manner equivalent to the interior compartments.

Variations of storage modules to suit particular applications for use in the drawer display and storage organizer system of the present invention are also presented.

An object of the present invention is to provide a drawer display and storage organizer system that utilizes the gap between storage modules and converts this space into suitable storage space.

An additional object of the present invention is to provide a drawer display and storage organizer system that is efficient and easy to use.

A further object of the present invention is to provide a drawer display and storage organizer system that allows all the surface space of the drawer to be efficiently used.

Another object of the present invention is to provide a drawer display and storage organizer system that can be easily constructed and re-constructed in different configurations to suit different types of items.

An additional object of the present invention is to provide a drawer display and storage organizer system that can be moved from drawer to drawer as needed.

These and other objects and advantages of the invention will become more fully apparent from the description and claims which follow, or may be learned by the practice of the invention. These and other objects, features, and advantages of the present invention will become more readily apparent from the attached drawings and from the detailed description of the preferred embodiments, which follow.

BRIEF DESCRIPTION OF THE DRAWINGS

The preferred embodiments of the invention will hereinafter be described in conjunction with the appended drawings, provided to illustrate and not to limit the invention, where like designations denote like elements, and in which:

FIG. 20 is a perspective view showing a second embodiment of the drawer display and storage organizer system of the present invention as assembled into a drawer; and FIG. 21 is a top view showing a second embodiment of the drawer display and storage organizer system of the present invention as assembled into a drawer.

Like reference numerals refer to like parts throughout the several views of the drawings.

DETAILED DESCRIPTION OF THE PREFERRED EMBODIMENTS

Shown throughout the figures, the present invention is directed toward a convenient drawer organizer storage and display system, which includes a display base member and at least one, and generally multiple, storage modules. The present invention utilizes the gap between storage modules and converts this space into attractive, functional storage space. The top surfaces of the display base member and of the storage module are configured to receive and hold personal items, such as jewelry or accessories. The display base member is additionally used to line the drawer bottom. A variety of storage modules are herein presented to meet various needs.

Figure 18:
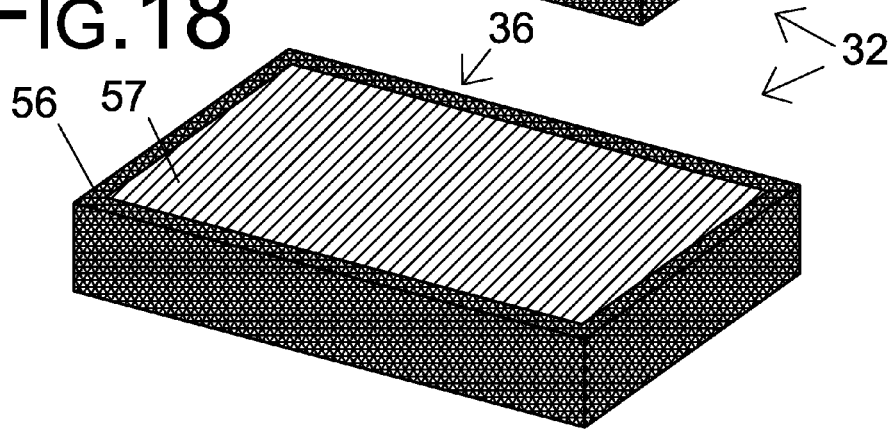
FIG. 18 is a bottom perspective view showing the covering materials of a multi-section storage module of the preferred first embodiment of the drawer display and storage organizer system.
Figure 19:
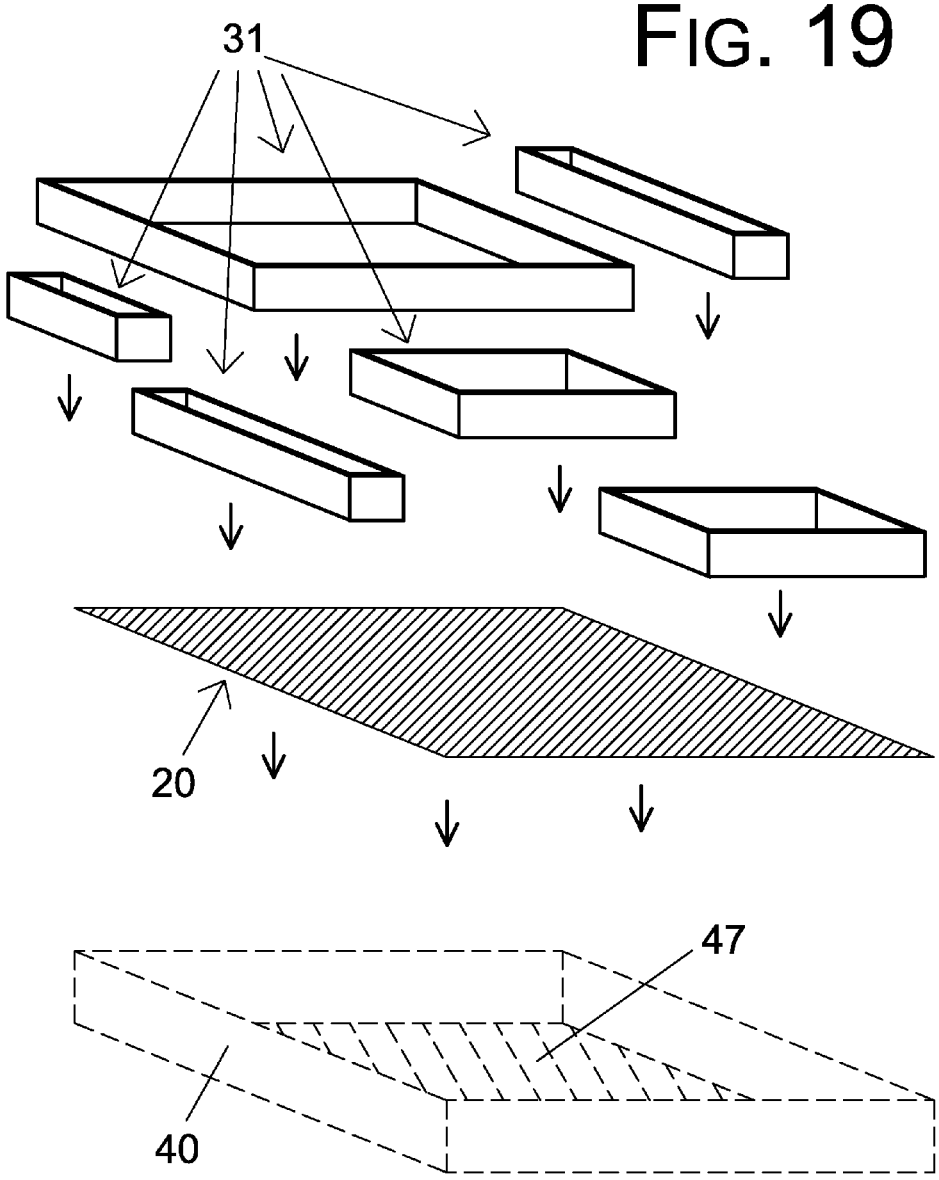
FIG. 19 is an expanded perspective view showing a second embodiment of the drawer display and storage organizer system of the present invention.

Two embodiments are presented, a first preferred embodiment (FIG. 1 to FIG. 18) and a second embodiment (FIG. 19 to FIG. 21). The two embodiments show variations in the types of the storage modules utilized with the display base member.

Figure 1:
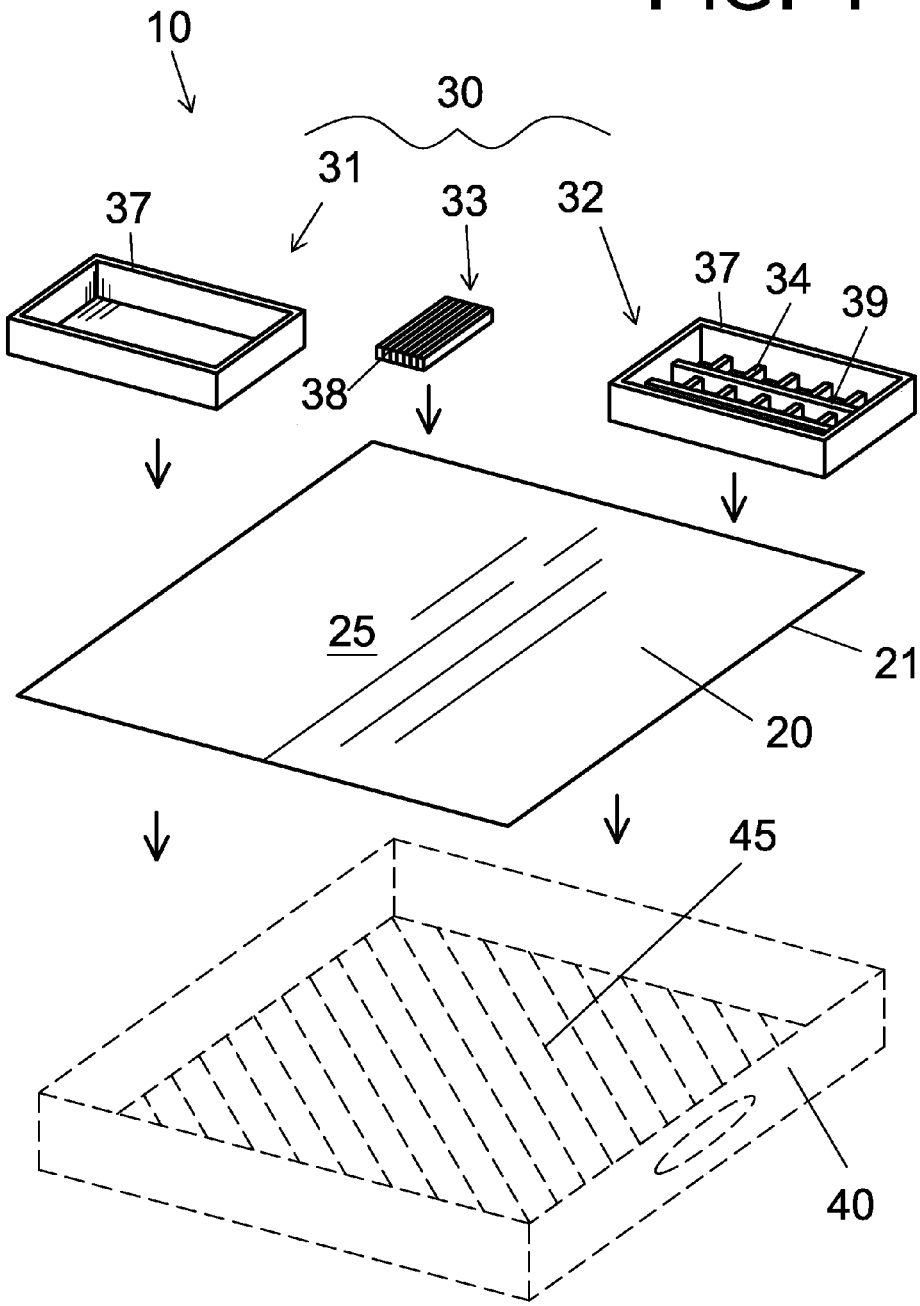
FIG. 1 is an expanded perspective view showing the components of a preferred first embodiment of the drawer display and storage organizer system of the present invention for placing into a conventional drawer.

Referring now to FIG. 1, a drawer display and storage organizer system, shown generally as reference number 10, is illustrated in accordance with a preferred first embodiment of the present invention. As shown, the drawer display and storage organizer system 10 comprises a display base member 20 and storage modules 30. Storage modules 30 comprise single-section storage module 31, multi-section storage module 32, and ring holder 33.

The display base member 20 is formed of a single piece of aesthetically appealing fabric. Preferably the fabric has a smooth, dense short pile face, such as velvet. Additionally, preferably the cut edge of the fabric is generally non-fraying. Optionally, plush fabrics, short fake fur fabrics, velveteen, other fabrics with a tufted face, anti-tarnish treated fabrics, suede, or felt could be used. The fabric of display base member 20 may be formed of natural materials (such as silk, mohair, linen, or cotton), synthetic materials (such as polyester, nylon, viscose, rayon, and acetate), or a combination of natural and synthetic materials. The dense short pile face is positioned upward in drawer 40 to form a surface display space 25.

Figure 2:
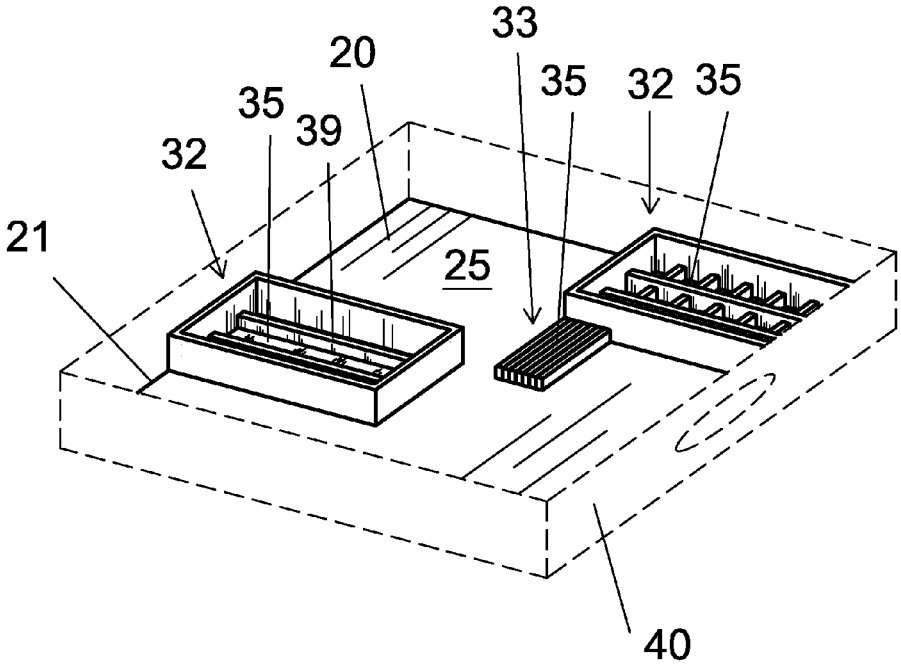
FIG. 2 is a perspective view showing a first exemplary arrangement of the preferred first embodiment of the drawer display and storage organizer system of the present invention assembled in a drawer.
Figure 3:
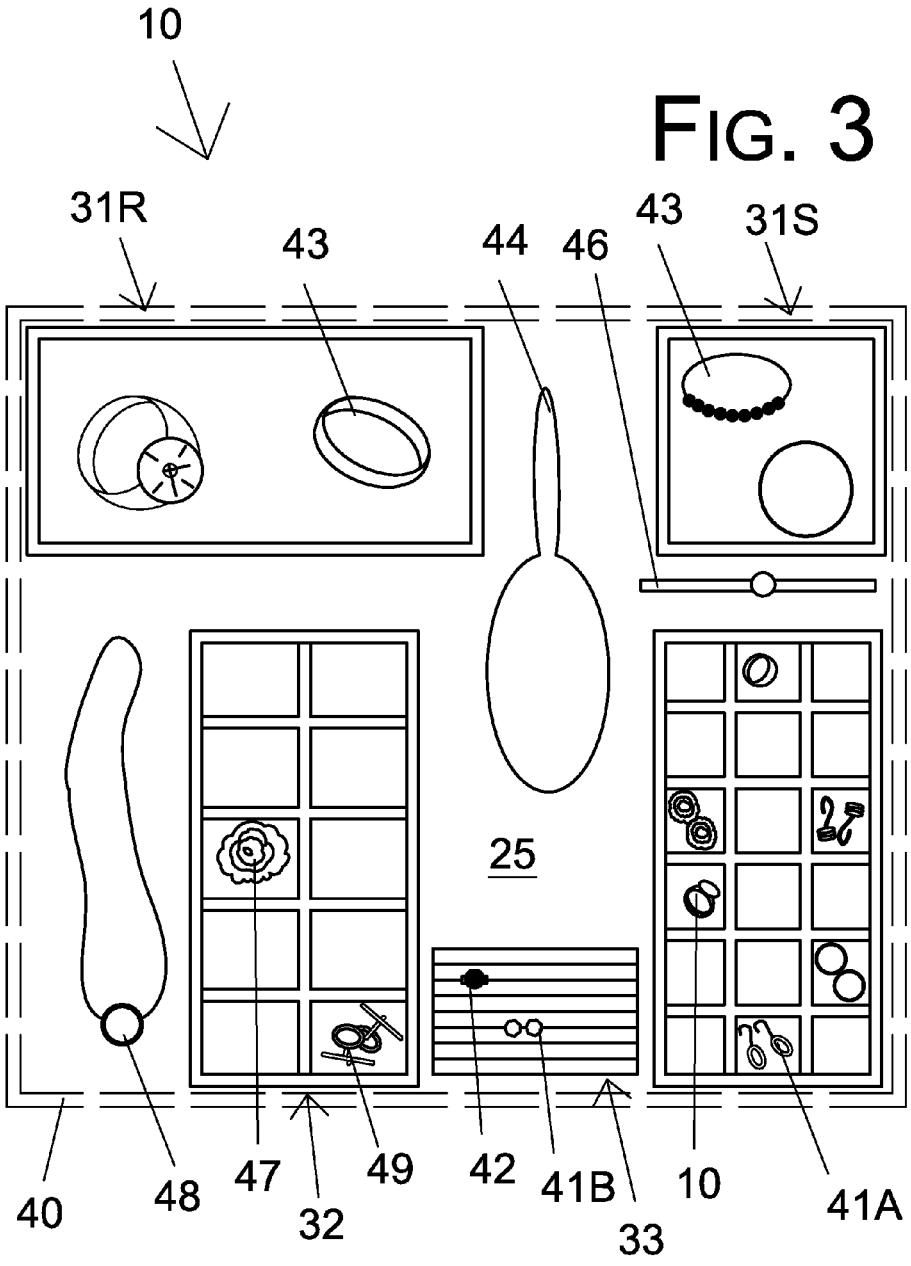
FIG. 3 is a top view showing a second exemplary arrangement of the preferred first embodiment of the drawer display and storage organizer system of the present invention assembled in a drawer.

As shown in FIG. 1 and FIG. 2, the base member 20 is inserted into drawer 40 covering drawer bottom 45. Then storage modules 30 are positioned as desired by the user onto base member 20 with any uncovered space of base member 20 forming surface display space 25 (FIG. 2, FIG. 3). Thus the space available for storage and exhibition of items includes both the module display space 35 within the storage modules 30 and the base surface display space 25 (the portion of the top surface of base member 20 between and around the storage modules 30, which remains uncovered by the storage modules 30).

The storage modules 30 are preferably covered with the same fabric used to form display base member 20. Thus when the storage modules 30 are placed onto the base member 20, the matching fabric provides an integrated, smooth visual flow from the display surface 25 of base member 20 to the modules 30. Storage modules 30 are preferably provided in multiple shapes and sizes to accommodate any of a variety of small items to be stored within the modules 30. The items to be stored are positioned in the module display space 35 of the interior of storage modules 30. Multiple styles of storage modules 30 (multi-section modules 32, single-section modules 31, ring holders 33) allow convenient configurations to store any of a variety of personal items, such as jewelry and accessories.

Figure 4:
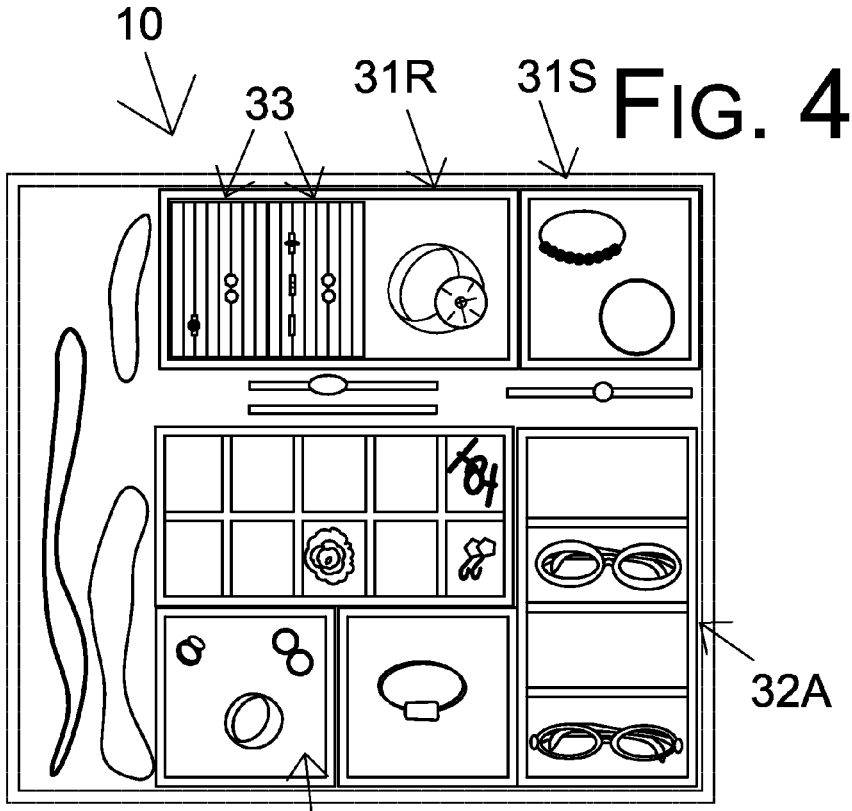
FIG. 4 is a top view showing a third exemplary arrangement of the preferred first embodiment of the drawer display and storage organizer system of the present invention assembled in a drawer.
Figure 5:
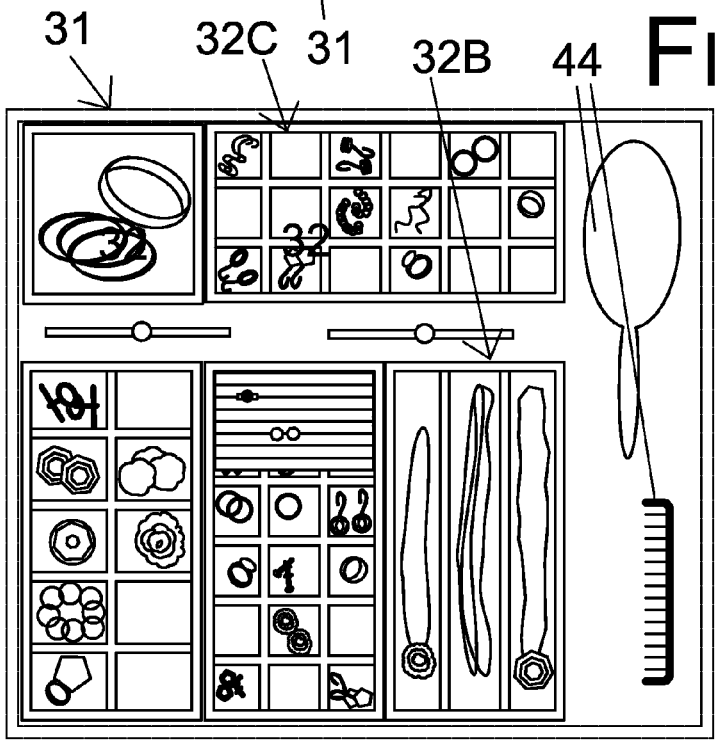
FIG. 5 is a top view showing a fourth exemplary arrangement of the preferred first embodiment of the drawer display and storage organizer system of the present invention assembled in a drawer.

FIG. 3, FIG. 4, and FIG. 5 show variations in the arrangement of the surface display space 25 and the module display spaces 35. To configure the drawer for optimum organization of the items, an appropriate layout of the multi-section module(s) 32, single-section module(s) 31, ring holder(s) 33, and base surface display space 25 is created. The user (such as the consumer, a professional installer, or an organizational specialist) analyzes the types and shapes of the items to be stored and/or displayed. The surface display space 25 is positioned in the drawer. Then the required number and types of multi-section modules 32, single-section modules 31, and ring holders 33 are chosen and positioned upon the surface display space 25.

As shown in FIG. 3, the base surface display space 25 may allow space for larger necklaces 48, larger accessories 44, and watch 46. Other personal items may be efficiently contained within storage modules 30. For example, a first set of earrings 41A may fit well in a multi-section module 32 and a second set of post earrings 41B may be held within the ring holder 33; bracelets 43 may fit well within a square single-section module 31S or within a rectangular single-section module 31R; and broaches 47 or cuff links may fit best within a multi-section module 32. However, the size, shape, and number of the items to be stored within the drawer 40 will determine the particular arrangement for a specific drawer 40.

FIG. 4 and FIG. 5 show other variations in the arrangements of the same types of storage modules 30 and of base surface display space 25, as in FIG. 3, to accommodate differing sizes, shapes, and numbers of items to be stored within the drawer 40.

FIG. 3, FIG. 4, and FIG. 5 also illustrate variations in the possible advantageous positions of one or multiple ring holders 33. FIG. 3 illustrates that a ring holder 33 (or multiple ring holders 33) can be positioned upon the base surface display space 25. FIG. 4 shows that multiple ring holders 33 (or a single ring holder 33) can be fitted within the open single-section module 31. FIG. 5 illustrates an optional stacked location for one or more ring holders 33, which is resting upon the dividers of multi-section module 32.

Figure 6:
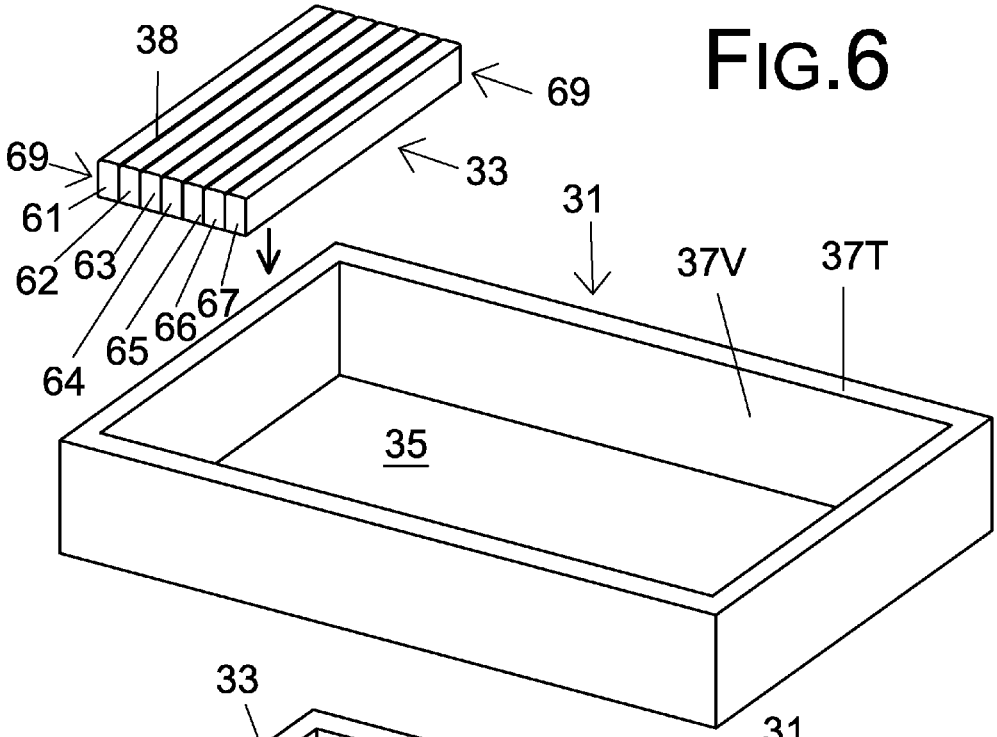
FIG. 6 is a perspective view showing a single-section storage module and a ring holder of the preferred first embodiment of the drawer display and storage organizer system.

FIG. 6 illustrates an exemplary open top single-section storage module 31, which may be rectangular (as shown in FIG. 6) or square (as shown in FIG. 3). The single-section storage module 31 comprises exterior walls 37 and a floor, all of which are fabric covered. The upper surface of the floor forms the interior module display space 35. The exterior walls 37 include both a vertical portion 37V and a top portion 37T. Preferably the walls 37 and module display space 35 are formed of wood covered with fabric corresponding to the fabric of base member 20, although other natural or manmade materials, such as bamboo or plastic. may be used. Thus the inner side of vertical portion 37V, the outer side of vertical portion 37V, and the top portion 37T of wall 37 are preferably neatly covered with the corresponding fabric. The four walls 37 of the storage module 30 are uniform in height, with the height being less than the height of the walls of the drawer 40 into which the storage module 30 will be inserted. Preferably the exterior walls 37 are approximately from 1 to 4 inches tall with a thickness of approximately between ⅛ inch and ½ inch. Thus the flat top portion 37T of wall 37 is approximately between ⅛ inch and ½ inch in width.

Figure 7:
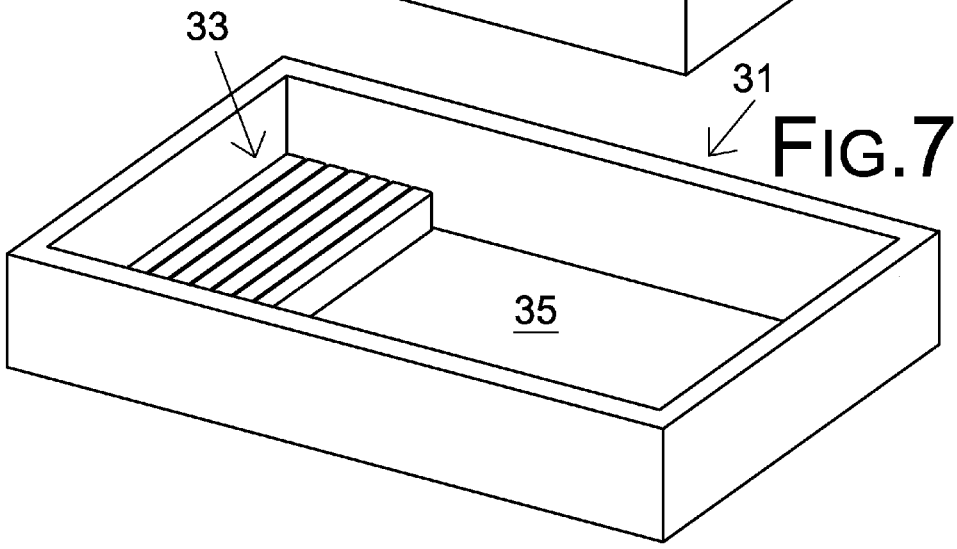
FIG. 7 is a perspective view showing the ring holder fitted within a single-section storage module of the preferred first embodiment of the drawer display and storage organizer system.

FIG. 6 also illustrates the ring holder 33 which is configured with open slots 38 to allow introduction of a portion of the items (rings, earrings, etc.) to be stored upon the ring holder 33. Preferably ring holder 33 is made of longitudinal fabric covered cushions 61, 26, 63, 64, 65, 66, 67 joined together at the ends 69 but with the area between each cushion (slots 38) open to receive the item to be stored. Ring holder 33 is sized to fit within the interior of storage module 31, as shown in FIG. 7. Ring holder 33 is manually slid downward to rest on the upper surface of the floor of storage module 31, thus covering a portion of the interior module display space 35.

Figure 8:
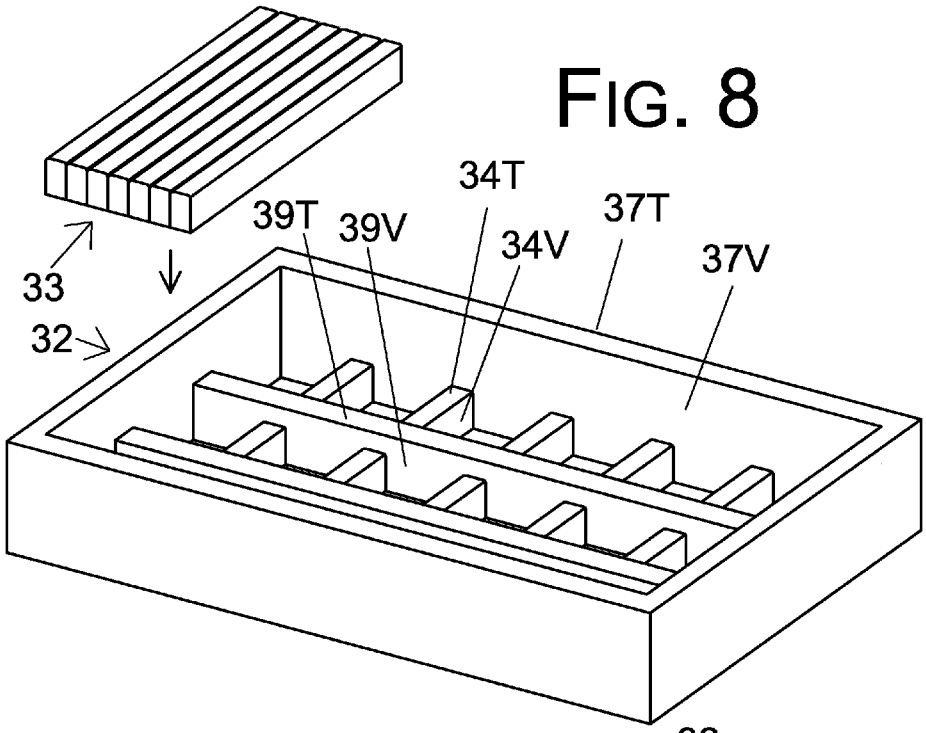
FIG. 8 is a perspective view showing a multi-section storage module and a ring holder of the preferred first embodiment of the drawer display and storage organizer system.

FIG. 8 illustrates an exemplary open top multi-section open storage module 32, which may be rectangular or square (not shown). Similar to the single-section storage module 31, the multi-section storage module 32 comprises exterior walls 37 (vertical portion 37V and top portion 37T) and a floor whose upper surface forms the interior module display space 35. Additionally, the multi-section storage module 32 comprises at least one longitudinal divider 39 (including vertical portion 39V and top portion 39T) and/or at least one lateral divider 34 (including vertical portion 34V and top portion 34T). Other variations of the multi-section modules 32 are shown in FIG. 2, FIG. 4, and FIG. 5. Multi-section module 32B (FIG. 5) is particularly designed to hold long thin items, such as necklaces; it has two longitudinal dividers 39. The multi-section module 32A (FIG. 4) has three lateral dividers 34; it is particularly designed for holding sunglasses. The sunglass-type multi-section module 32A may optionally be slightly wider than the earring-type multi-section module 32C (FIG. 5) to accommodate larger sunglasses.

Preferably the walls 37, longitudinal divider(s) 39, multiple lateral dividers 34, and floor are formed of wood covered with fabric corresponding to the fabric of base member 20. Preferably the width of the wood forming the dividers 34, 39 is sufficiently wide to provide a flat top 34T, 39T, as illustrated. The four walls 37 of the multi-section storage module 32 are uniform in height, with the height less than the drawer 40 wall height and with the height equal to other modules 30. However, the longitudinal divider 39 and lateral dividers 34 are preferably reduced in height compared to the exterior walls 37. The reduction in height of the dividers 34, 39 allows convenient access to the items stored within the modules 30. Most preferably, as illustrated in FIG. 8, the lateral dividers 34 are reduced in height compared to the longitudinal dividers 39 to further facilitate access to the stored items.

Figure 9:
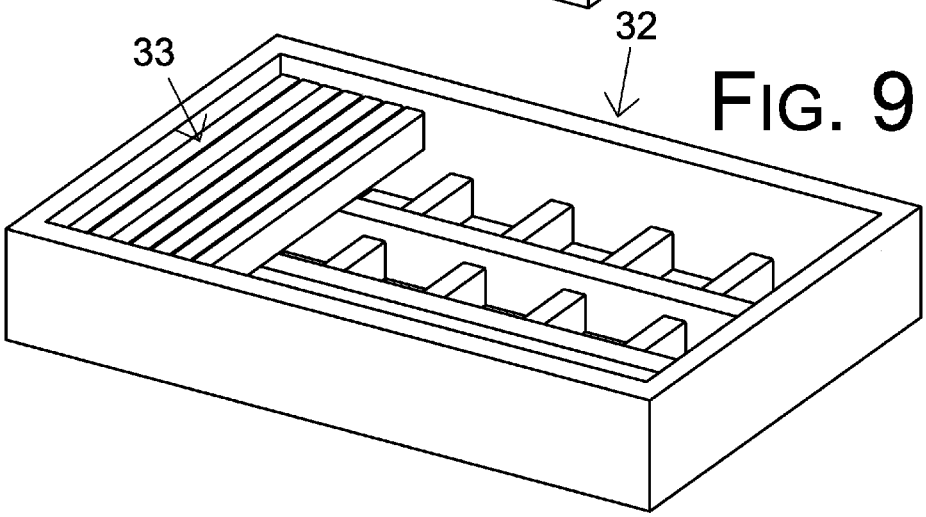
FIG. 9 is a perspective view showing the ring holder fitted within a multi-section storage module of the preferred first embodiment of the drawer display and storage organizer system.

FIG. 9 illustrates that ring holder 33 also is sized to fit between the longitudinal walls 37 of the multi-section storage modules 32. The ring holder 33 may be manually slid downward to rest on the top upper surface 39T of the one or more longitudinal dividers 39. It is supported not only by the top upper surface 39T but by a slight friction with the exterior walls 37. Thus the insertion of one or more ring holders 33 over some compartments of the multi-section storage module 32 allows a second layer of stored items.

Though the entire exterior surface area of the storage modules 30 (side walls 37, dividers 34, 39 and module display space 35, bottom 36) can be covered in a fabric corresponding to the fabric of the base member 20, a portion of the underside of the bottom 36 may optionally be covered in a separate material, as shown later in FIG. 15 and FIG. 18.

FIG. 10 to FIG. 13 illustrate optional edge treatments of the display base member 20. These optional edge treatments include a cut-to-fit edge 27 and a folded-under edge 26.

Figures 10, 11, 12, 13, 14:
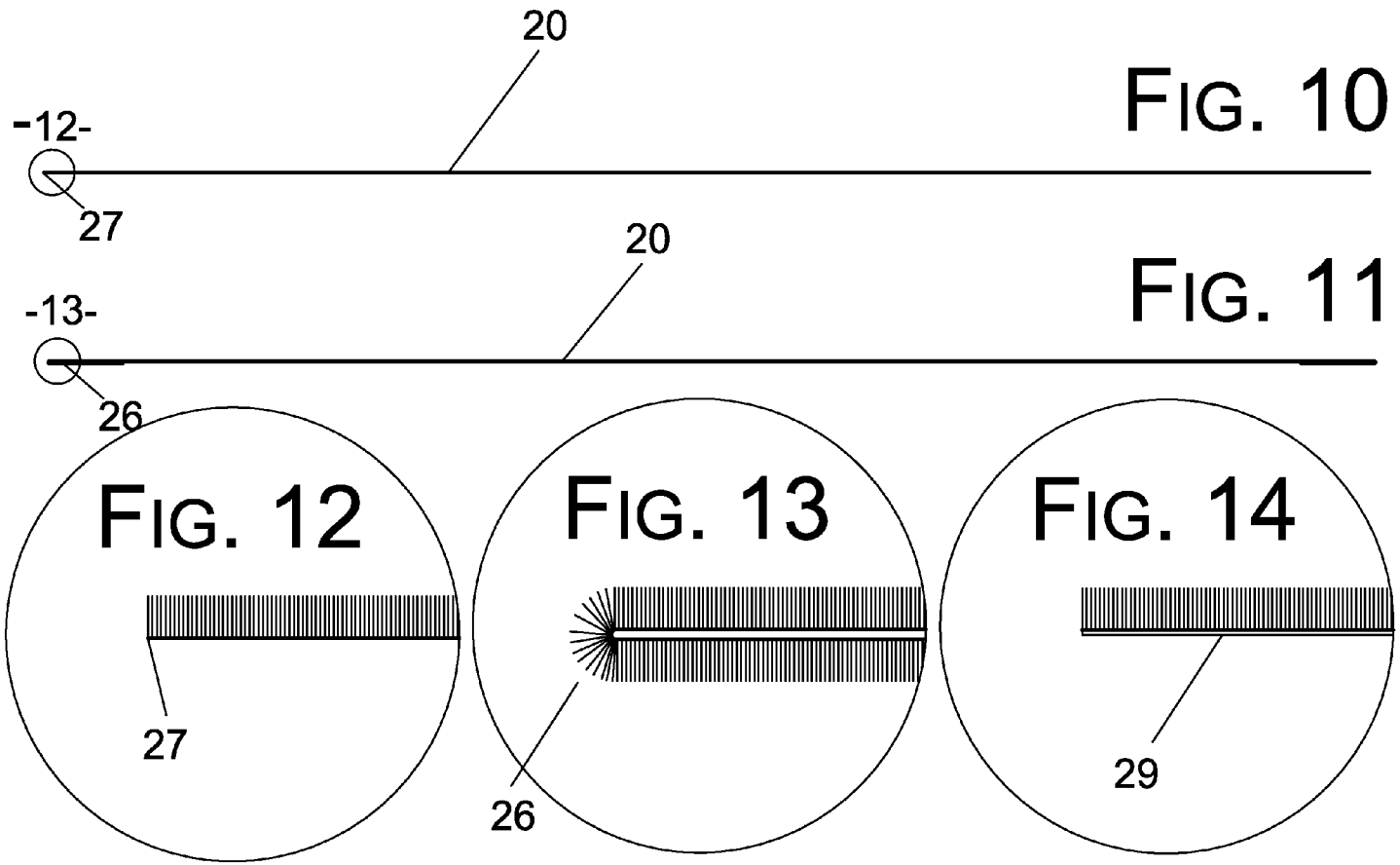
FIG. 10 is a side view showing a first aspect of the base member of the drawer display and storage organizer system of the present invention.
FIG. 11 is a side view showing a second aspect of the base member of the drawer display and storage organizer system of the present invention.
FIG. 12 is a side view showing a detail view taken from circle -12- of FIG. 10 of the base member of the drawer display and storage organizer system of the present invention.
FIG. 13 is a side view showing a detail view taken from circle -13- of FIG. 11 of the base member of the drawer display and storage organizer system of the present invention.
FIG. 14 is a side view showing a detail view of the same area of the base member as shown in FIG. 12 and FIG. 13, but showing a third aspect of the base member of the drawer display and storage organizer system of the present invention.

FIG. 10 and FIG. 12 show the cut-to-fit edge 27. For a close fit, the base member 20 may be custom cut to fit the interior bottom 45 (FIG. 1) of drawer 40. The base member 20 may be pre-cut by the supplier to match exact measurements provided by the user. Alternatively, the base member 20 may be cut on site by the user. The cut-to-fit edge 27 gives a smooth margin without the bulk of a folded-under edge 26. However, the cut-to-fit edge 27 may be more costly and would not be as readily reusable in another drawer (such as when the user moves to a new house with different drawer sizes or decides to move the drawer organizer system 10 to another drawer).

FIG. 11 and FIG. 13 show the folded-under edge 26. The fabric of display base member 20 is provided in a size large enough to allow a portion of one or more of the edges to be manually turned under. The fabric of base member 20 is thin enough to fold well and to form a minimal bulge near the folded-under edge 26. Advantageously, the display base member 20 may be removed, unfolded, and reused in a drawer 40 of a different size.

FIG. 14 illustrates a cut-to-fit edge 27 including an underlayment, adhesive 29. The adhesive 29 is applied to the lower surface of base member 20 to allow a further securing of base member 20 to the drawer bottom 45. Adhesive 29 may be only minimally tacky to allow convenient smoothing and positioning. Optionally, adhesive 29 may provide a greater degree of attachment, making the base member 20 more permanently adhered to the drawer bottom 45.

Figure 15:
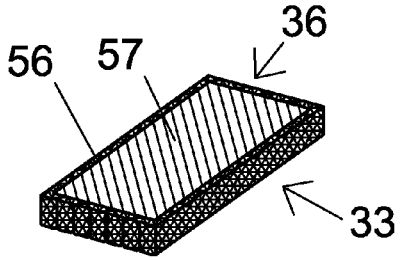
FIG. 15 is a bottom perspective view showing the covering materials of a ring holder of the preferred first embodiment of the drawer display and storage organizer system.
Figure 16:
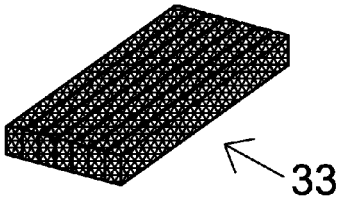
FIG. 16 is a top perspective view showing the covering material of a ring holder of the preferred first embodiment of the drawer display and storage organizer system.
Figure 17:
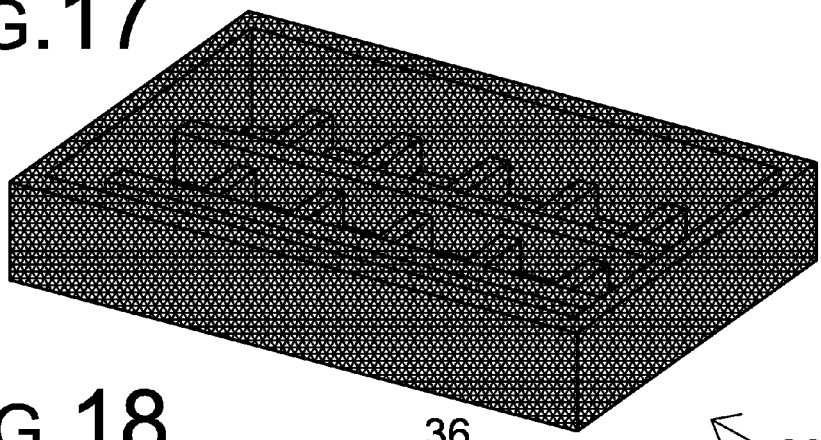
FIG. 17 is a top perspective view showing the covering material of a multi-section storage module of the preferred first embodiment of the drawer display and storage organizer system.

FIG. 15 to FIG. 18 illustrate a corresponding first fabric (corresponding to the fabric of the base member 20) covering the side walls 37, dividers 34, 39 and module display space 35. As seen in FIG. 15 and FIG. 18, a portion of this first fabric extends around the bottom corners and onto a portion of the lower surface of storage module bottom 36. A second material 57 covers the center area of bottom 36. The second material 57 may be a second type of fabric or may be a sheet of paper, plastic, or other smooth flat overlay to cover the underneath material forming the bottom.

The extension 56 of the corresponding top fabric onto at least a portion of the storage module bottom 36 not only gives the storage module 30 a completely covered, neat appearance when viewed from the top or sides, it also provides a degree of friction. When the downward-facing short, dense pile face of the corresponding fabric extension 56 is positioned on top of the upward-facing short dense pile face of the base member's display surface 25, any tendency of the storage module 30 to slip is reduced. Thus adhesive 29 is generally not required as the weight of the storage modules 30 combined with the frictional engagement of the fabric extension 56 with the base display surface 25 is sufficient to reduce slippage.

FIG. 19-FIG. 21 illustrate a second embodiment, which is similar to the first embodiment, but illustrates that the drawer display and storage organizer system 10 of the present invention can be implemented using modules of varying sizes, types, and shapes. Further, the drawer display and storage organizer system 10 can be implemented using only multi-section storage modules 32 (FIG. 8) or, as shown, using only single-section storage modules 31. Though using multi-section storage modules 32 and ring holders 33 add to the versatility of the invention, the storage module display space 35 and the base member display space 25 are also provided with simple single-section storage modules resting upon the base member 20.

To use the drawer display and storage organizer system of the present invention, the user observes the size, shape, type, and number of items to be stored within a drawer. Based on these item characteristics, the user selects appropriate storage modules 30 and determines a design for storing the items within the storage modules 30 and upon the base member display surface 25. Optionally, the base member 20 may be cut to fit the drawer bottom 45.

The user then places the base member 20 onto the drawer bottom 45. If the base member 20 has been cut to fit the drawer bottom 45, the base member 20 is merely positioned within the walls of the drawer 40 onto drawer bottom 45. If the base member 20 has not been cut to fit, the user folds one or more sides under to reduce the width and/or length of the base member 20 to create a base member 20 having a size corresponding to the size of the drawer bottom 45; and next positions the folded-edge base member 20 onto the drawer bottom 45.

The user then positions the selected storage modules 30 onto the base member 20 in the particular determined design with any unutilized surface of the display base member 20 functioning as a base display space 25. The items to be stored within the storage modules 30 are placed within them. The items to be stored upon the base member display surface 25 are positioned upon it.

From the foregoing, it will be apparent that the drawer display and storage organizer system 10 of the current invention utilizes the gaps around and between storage modules to create suitable storage spaces, thus efficiently using all of the space of the drawer. The drawer display and storage organizer system is efficient and easy to use. The storage modules can be rearranged in different configurations to suit different types of items.

Since many modifications, variations, and changes in detail can be made to the described preferred embodiments of the invention, it is intended that all matters in the foregoing description and shown in the accompanying drawings be interpreted as illustrative and not in a limiting sense. Thus, the scope of the invention should be determined by the appended claims and their legal equivalents.

I claim:

1. An organizational system for storing items in a drawer, consisting of:

a removable display base member comprising a single piece of fabric having a dense pile face and having two opposing lateral edges and two opposing longitudinal edges; wherein said display base member is manually positionable to overlay the interior surface of said drawer bottom with each of said two opposing lateral cut edges positioned against opposing lateral sides of said drawer and with each of said two opposing longitudinal cut edges positioned against opposing longitudinal sides of said drawer, and wherein the top surface of said display base member forms a display surface configured for receiving one or more of said items;

a plurality of removable and repositionable storage module comprising a first storage module; wherein said first storage module has a first module floor and four first module side walls defining a first interior compartment adapted to receive one or more of said items; wherein the upper surface of said first module floor, at least a portion of the bottom surface of said first module floor, and the inner, outer, and top surfaces of said first module four side walls are covered with a velvet fabric corresponding to said velvet fabric of said display base member; wherein, upon manual placement of said first module onto said display base member, said velvet fabric covering of said at least a portion of the bottom surface frictionally interacts with said dense pile face, whereby slippage is minimized;

a removable and repositionable second storage module; wherein:

said second storage module has a second module floor and four second module side walls defining a second interior compartment adapted to receive one or more of said items;

the upper surface of said second module floor, at least a portion of the bottom surface of said second module floor, and the inner, outer, and top surfaces of said four second module side walls are covered with a velvet fabric corresponding to said fabric of said display base member;

said velvet fabric covering of said at least a portion of the bottom surface frictionally interacts with said dense pile face upon manual placement of said second module onto said display base member, whereby slippage is minimized;

said first storage module and said second storage module are sized to fit simultaneously onto said display surface of said drawer while allowing at least a portion of said display surface to be uncovered;

a removable and repositionable ring holder module comprising a plurality of longitudinal fabric covered cushions joined together in a manner to create a top having open slots allowing introduction of a portion of a jewelry item; wherein said ring holder module has two opposing exterior walls; wherein the distance between the exterior portions of said two opposing exterior walls is substantially equal to the distance between the interior portions of two opposing ones of said first module four side walls to allow said ring holder module to be manually positionable within said first storage module.

2. The organizational system for storing items in a drawer, as recited in claim 1, wherein said fabric of said display base member comprises a velvet material.

3. The organizational system for storing items in a drawer, as recited in claim 1, wherein the length or width of said display base member is larger than the length or width of said bottom of said drawer, whereby to use the display base member to overlay said bottom of said drawer, at least one edge of said display base member is manually folded under to cause said display base member to generally correspond in size to said bottom of said drawer.

4. The organizational system for storing items in a drawer, as recited in claim 1, wherein said display base member is cut to generally fit the length and width of said drawer, wherein the edges of said two opposing lateral cut edges fit against the lateral sides of said drawer and wherein the edges of said two opposing longitudinal cut edges fit against the longitudinal sides of said drawer.

5. The organizational system for storing items in a drawer, as recited in claim 1, wherein said display base member is removable from said drawer.

6. The organizational system for storing items in a drawer, as recited in claim 1, wherein said display base member further comprises an underlayment of adhesive and said display base member is adhesively attachable to said bottom of said drawer by said adhesive.

7. The organizational system for storing items in a drawer, as recited in claim 1, wherein said first storage module and said second storage module each have a height less than the height of said drawer, a length of less than half the length of said drawer, and a width of less than half the width of said drawer.

8. The organizational system for storing items in a drawer, as recited in claim 1, said plurality of removable and repositionable storage modules further comprising a removable and repositionable multi-section storage module sized and adapted to fit within said drawer; wherein:

said multi-section storage module has a multi-section module floor and four multi-section module side walls defining an interior compartment adapted to receive one or more of said items;

the upper surface of said multi-section module floor and the inner, outer, and top surfaces of said multi-section four side walls are covered with a fabric corresponding to said fabric of said display base member; and wherein, upon placing said multi-section storage module upon said display base member, one or more areas of said display base member that remain uncovered form a display surface for receiving one or more of said items;

said multi-section storage module comprises at least one longitudinal divider extending from one of said four first module side walls to an opposing second one of said four first module side walls;

said multi-section storage module comprises at least one lateral divider extending from a third one of said four first module side walls to an opposing fourth one of said first module side walls; and said at least one longitudinal divider and said at least one lateral divider have a height less than the height of said four multi-section side walls.

9. The organizational system for storing items in a drawer, as recited in claim 8, wherein said four first module side walls, said first module floor, said four second module side walls, said second module floor, said multi-section module side walls, and said multi-section dividers are formed of wood.

* * * * *